US009971299B2

(12) United States Patent
Abe et al.

(10) Patent No.: US 9,971,299 B2
(45) Date of Patent: May 15, 2018

(54) DEVELOPING CARTRIDGE PROVIDED WITH CASING INCLUDING PRESSURE MEMBER

(71) Applicant: BROTHER KOGYO KABUSHIKI KAISHA, Nagoya-shi, Aichi-ken (JP)

(72) Inventors: Koji Abe, Nagoya (JP); Motoaki Mushika, Hashima (JP); Kazuna Taguchi, Nagoya (JP); Yasuo Fukamachi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/378,844

(22) Filed: Dec. 14, 2016

(65) Prior Publication Data

US 2017/0269504 A1 Sep. 21, 2017

(30) Foreign Application Priority Data

Mar. 15, 2016 (JP) ..... 2016-051434

(51) Int. Cl.
*G03G 21/00* (2006.01)
*G03G 21/18* (2006.01)

(52) U.S. Cl.
CPC ..... *G03G 21/1821* (2013.01); *G03G 21/1846* (2013.01); *G03G 2221/1846* (2013.01); *G03G 2221/1869* (2013.01)

(58) Field of Classification Search
CPC ..... G03G 21/1821; G03G 21/1846; G03G 2221/163; G03G 2221/1846; G03G 2221/1869

(Continued)

(56) References Cited

U.S. PATENT DOCUMENTS 5,794,103 A * 8/1998 Oh ..... G03G 21/1846 399/110
7,561,827 B2 * 7/2009 Shiraki ..... G03G 15/0896 399/111

(Continued)

FOREIGN PATENT DOCUMENTS

JP 2006-337502 A 12/2006
JP 2010-079205 A 4/2010

(Continued)

OTHER PUBLICATIONS

International Search Report and Written Opinion from corresponding International Patent Application No. PCT/JP2016/087092, dated Mar. 14, 2017.

(Continued)

*Primary Examiner* — Robert Beatty
(74) *Attorney, Agent, or Firm* — Merchant & Gould P.C.

(57) ABSTRACT

A developing cartridge includes a casing and a developing roller. The casing has an accommodation chamber, first and second ribs, a handle, and first and second pressure members. The accommodation chamber has one end portion and another end portion in a first direction, and an outer surface. The developing roller is positioned at one side of the accommodation chamber in a second direction. The ribs, the handle, and the pressure members are positioned at another side of the accommodation chamber in the second direction. The ribs and the pressure members are positioned at the outer surface. The handle is positioned between the first rib and the second rib in the first direction. The first pressure member is positioned between the handle and the first rib in the first direction. The second pressure member is positioned between the handle and the second rib in the first direction.

10 Claims, 7 Drawing Sheets

(58) Field of Classification Search
USPC ..... 399/113
See application file for complete search history.

(56) References Cited

U.S. PATENT DOCUMENTS

| | | | | |
|---|---|---|---|---|
| 7,565,092 | B2 * | 7/2009 | Shiraki | G03G 21/1857 399/111 |
| 7,813,672 | B2 * | 10/2010 | Shiraki | G03G 21/1821 399/119 |
| 7,986,897 | B2 * | 7/2011 | Nishimura | G03G 21/1821 399/90 |
| 9,423,769 | B2 * | 8/2016 | Tanaka | G03G 21/1846 |
| 2005/0191090 | A1 * | 9/2005 | Nishimura | G03G 21/1821 399/113 |
| 2006/0275052 | A1 | 12/2006 | Ishikawa | |
| 2013/0051851 | A1 | 2/2013 | Fukamachi | |
| 2015/0192894 | A1 | 7/2015 | Noda et al. | |

FOREIGN PATENT DOCUMENTS

| | | | |
|---|---|---|---|
| JP | 2010-107699 | A | 5/2010 |
| JP | 2013-050493 | A | 3/2013 |
| JP | 2015-129816 | A | 7/2015 |

OTHER PUBLICATIONS

English translation of International Search Report and Written Opinion from corresponding International Patent Application No. PCT/JP2016/087092, dated Mar. 14, 2017.

* cited by examiner

DEVELOPING CARTRIDGE PROVIDED WITH CASING INCLUDING PRESSURE MEMBER

CROSS REFERENCE TO RELATED APPLICATION

This application claims priority from Japanese Patent Application No. 2016-051434 filed Mar. 15, 2016. The entire content of the priority application is incorporated herein by reference.

TECHNICAL FIELD

The present disclosure relates to a developing cartridge.

BACKGROUND

A developing cartridge including a developing roller is known in the art. The developing cartridge is attachable to and detachable from a drum cartridge including a photosensitive drum. The photosensitive drum is rotatable about an axis extending in a first direction.

A conventional developing cartridge includes a casing and a developing roller. The casing defines an accommodation chamber for accommodating developing agent. The developing roller is positioned at one side of the accommodation chamber in a second direction. The drum cartridge has one end portion and another end portion away from the one end portion in the second direction. The drum cartridge includes a photosensitive drum and a pressure member. The photosensitive drum is positioned at the one end portion of the drum cartridge. The pressure member is positioned at the other end portion of the drum cartridge. The casing of the developing cartridge is pressed by the pressure member when the developing cartridge is attached to the drum cartridge. Thus, the developing roller is pressed against the photosensitive drum.

SUMMARY

It is assumed that the pressure member may be provided at the developing cartridge. In this case, the pressure member may be provided at another side of the accommodation chamber in the second direction. According to the conventional developing cartridge, a gear such as a coupling gear may be provided at a side surface of the accommodation chamber. Further, a rib for positioning the developing cartridge relative to the drum cartridge may be provided at the side surface of the accommodation chamber. Further, a handle may be provided at the other side of the accommodation chamber in the second direction. Therefore, the pressure member must be arranged avoiding interference with the rib and/or the handle.

It is therefore an object of the disclosure to provide a developing cartridge capable of pressing the developing roller toward the photosensitive drum while avoiding interference of the pressure member with the rib and/or the handle.

In order to attain the above and other objects, according to one aspect, the disclosure provides a developing cartridge including a casing and a developing roller. The casing has an accommodation chamber configured to accommodate developing agent. The accommodation chamber has one end portion and another end portion in a first direction. The accommodation chamber has an outer surface. The developing roller is rotatable about an axis extending in the first direction. The developing roller is positioned at one side of the accommodation chamber in a second direction different from the first direction. The casing includes: a first rib, a second rib, a handle, a first pressure member, and a second pressure member. The first rib extends in the second direction. The first rib is positioned at the outer surface. The first rib is positioned at the one end portion of the accommodation chamber in the first direction. The first rib is positioned at another side of the accommodation chamber in the second direction. The second rib extends in the second direction. The second rib is positioned at the outer surface. The second rib is positioned at the another end portion of the accommodation chamber in the first direction. The second rib is positioned at the another side of the accommodation chamber in the second direction. The handle is positioned at the another side of the accommodation chamber in the second direction. The handle is positioned between the first rib and the second rib in the first direction. The first pressure member is positioned at the outer surface. The first pressure member is positioned at the another side of the accommodation chamber in the second direction. The first pressure member is positioned between the handle and the first rib in the first direction. The second pressure member is positioned at the outer surface. The second pressure member is positioned at the another side of the accommodation chamber in the second direction. The second pressure member is positioned between the handle and the second rib in the first direction.

According to another aspect, the disclosure provides a developing cartridge configured to be attached to a drum cartridge including a photosensitive drum and a cartridge frame. The developing cartridge includes a casing and a developing roller. The casing has an accommodation chamber configured to accommodate developing agent The accommodation chamber has an outer surface. The developing roller is rotatable about an axis extending in a first direction. The developing roller is positioned at one side of the accommodation chamber in a second direction different from the first direction, the casing includes a handle and a pressure member. The handle is positioned at another side of the accommodation chamber in the second direction. The pressure member is positioned at the outer surface. The pressure member is positioned at the another side of the accommodation chamber in the second direction. The pressure member is positioned at a position corresponding to the handle in the first direction. The pressure member is in contact with the cartridge frame in a state where the developing cartridge is attached to the drum cartridge.

BRIEF DESCRIPTION OF THE DRAWINGS

The particular features and advantages of the disclosure will become apparent from the following description taken in connection with the accompanying drawings, in which.

DETAILED DESCRIPTION

1. Developing Cartridge 1

A developing cartridge according to a first embodiment will be described with reference to FIGS. 1 through 3B.

1.1 Outline of Developing Cartridge 1

Figure 1:
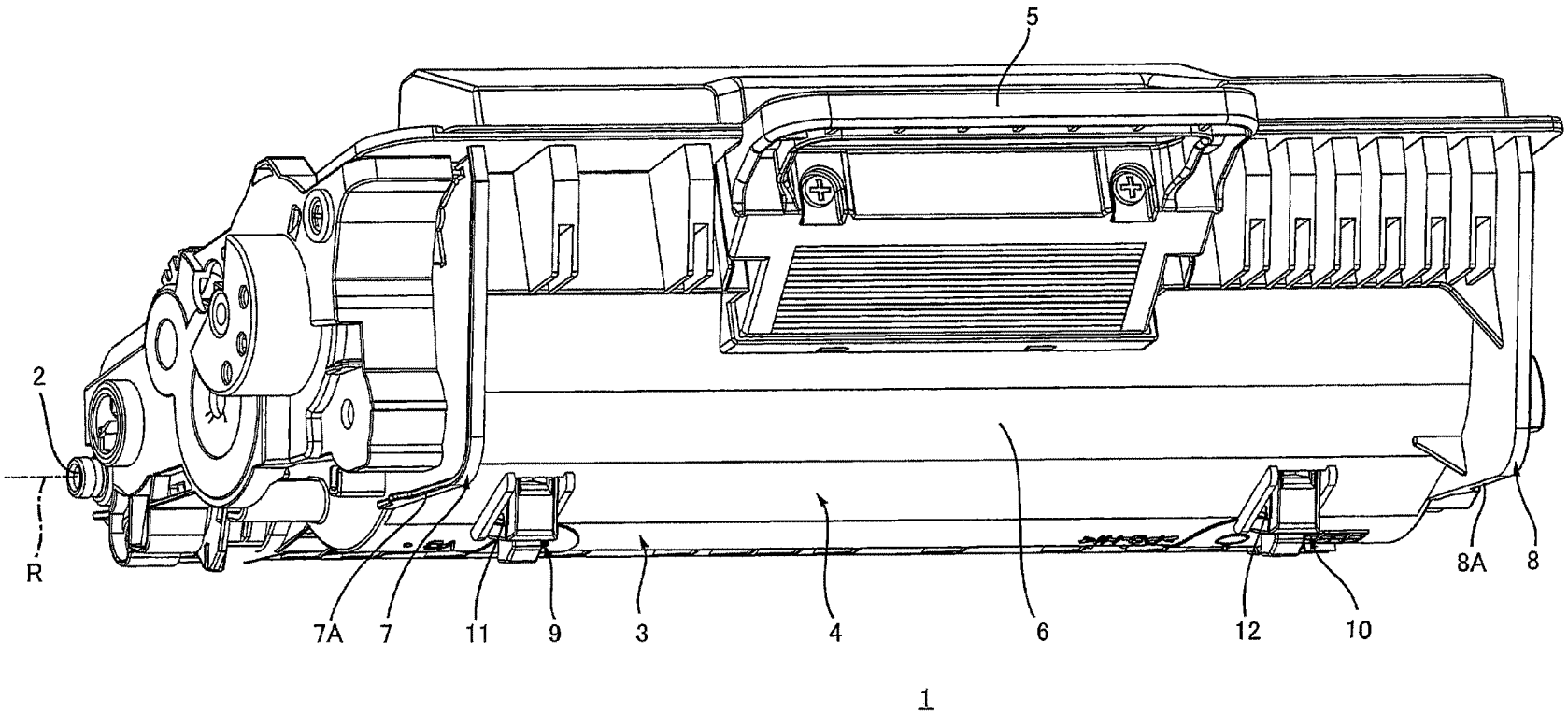
FIG. 1 is a perspective view of a developing cartridge according to a first embodiment.

An outline of a developing cartridge 1 will be described with reference to FIGS. 1 and 2. As illustrated in FIG. 1, the developing cartridge 1 includes a developing roller 2, and a casing 3. The developing roller 2 is configured to carry developing agent, and extends in a first direction. The developing roller 2 is rotatable about an axis R extending in the first direction. The casing 3 is configured to accommodate therein the developing agent. For example, the developing agent may be powdery toner.

As illustrated in FIGS. 1 through 3A, the casing 3 includes a developing agent accommodation chamber 4, a handle 5, a first rib 7, a second rib 8, a first pressure member 9 and a second pressure member 10.

1.2 Developing Agent Accommodation Chamber 4

The casing 3 defines therein the developing agent accommodation chamber 4. The developing agent accommodation chamber 4 is configured to accommodate therein developing agent. The developing agent accommodation chamber 4 has a polygonal tubular shape. The developing agent accommodation chamber 4 is positioned between the developing roller 2 and the handle 5 in the second direction different from the first direction. In the first embodiment, the second direction may be orthogonal to the first direction. The developing agent accommodation chamber 4 is an example of an accommodation chamber.

The developing roller 2 is positioned at one side of the casing 3 in the second direction. That is, the developing roller 2 is positioned at one side of the developing agent accommodation chamber 4 in the second direction. The handle 5 is positioned at another side of the developing agent accommodation chamber 4 in the second direction. The developing agent accommodation chamber 4 has an outer surface 6 positioned between the handle 5 and the developing roller 2 in the second direction. The outer surface 6 is an outer surface positioned at another side of the casing 3 in the second direction. That is, the outer surface 6 is an outer surface positioned at the other side of the developing agent accommodation chamber 4 in the second direction.

1.3 Handle 5

The handle 5 is positioned at the other side of the casing 3 in the second direction. More specifically, the handle 5 is positioned at the outer surface 6 as illustrated in FIG. 1. The handle 5 is positioned at an intermediate portion of the outer surface 6 in the first direction, and may protrude from the outer surface 6 in the second direction.

1.4 Agitator 18

Figures 3A, 3B:
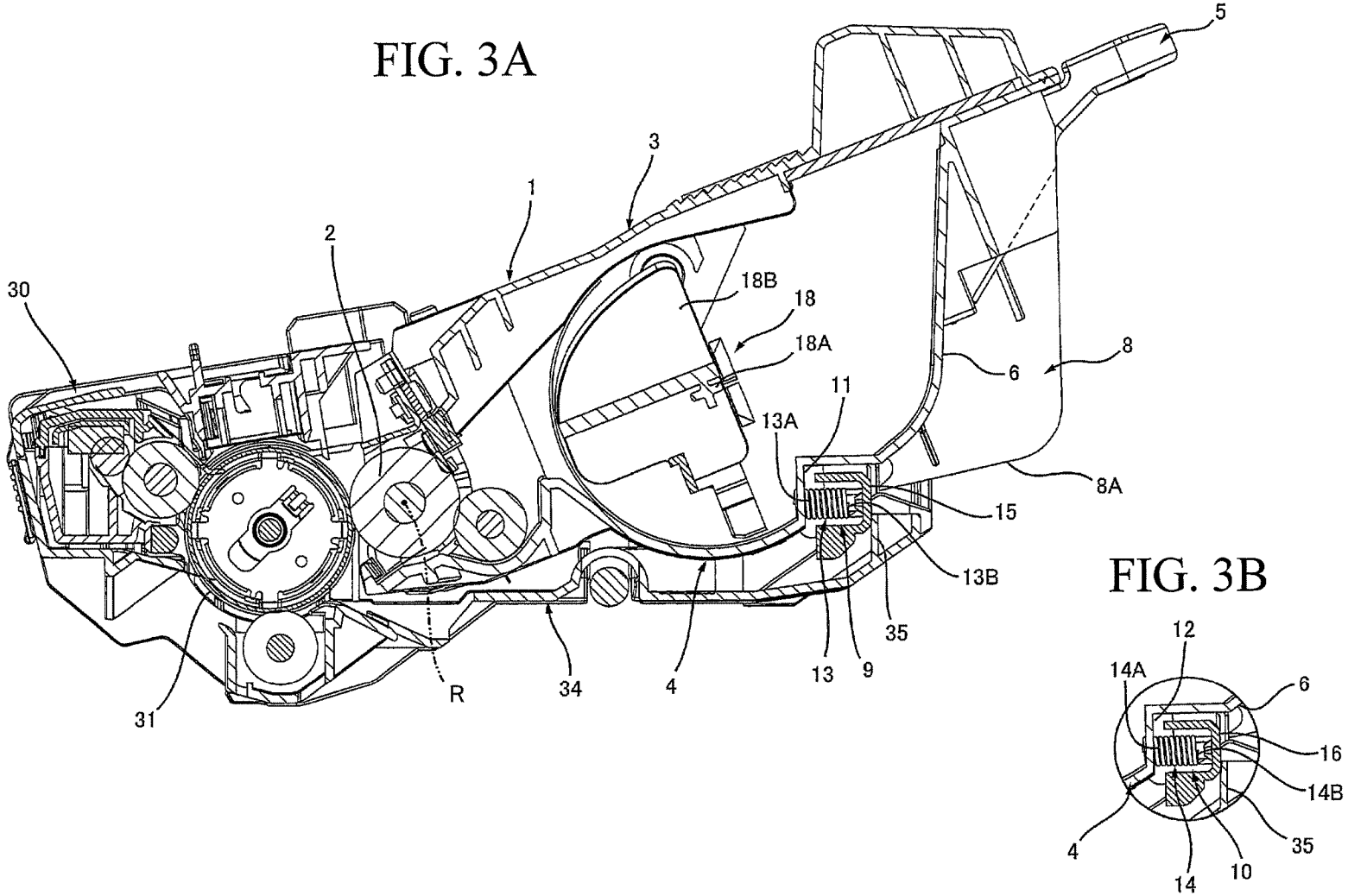
FIG. 3A is a cross-sectional view taken along a line A-A of FIG. 3.
FIG. 3B is a cross-sectional view taken along a line B-B of FIG. 3.

The developing cartridge 1 further includes an agitator 18 as illustrated in FIGS. 3A and 3B. The agitator 18 is positioned at an internal space of the developing agent accommodation chamber 4. The agitator 18 is capable of agitating developing agent in the developing agent accommodation chamber 4. The agitator 18 is spaced away from the developing roller 2 in the second direction, and is rotatable about an axis extending in the first direction. The agitator 18 includes an agitator shaft 18A and fins 18B.

1.5 First Rib 7 and Second Rib 8

Figure 2:
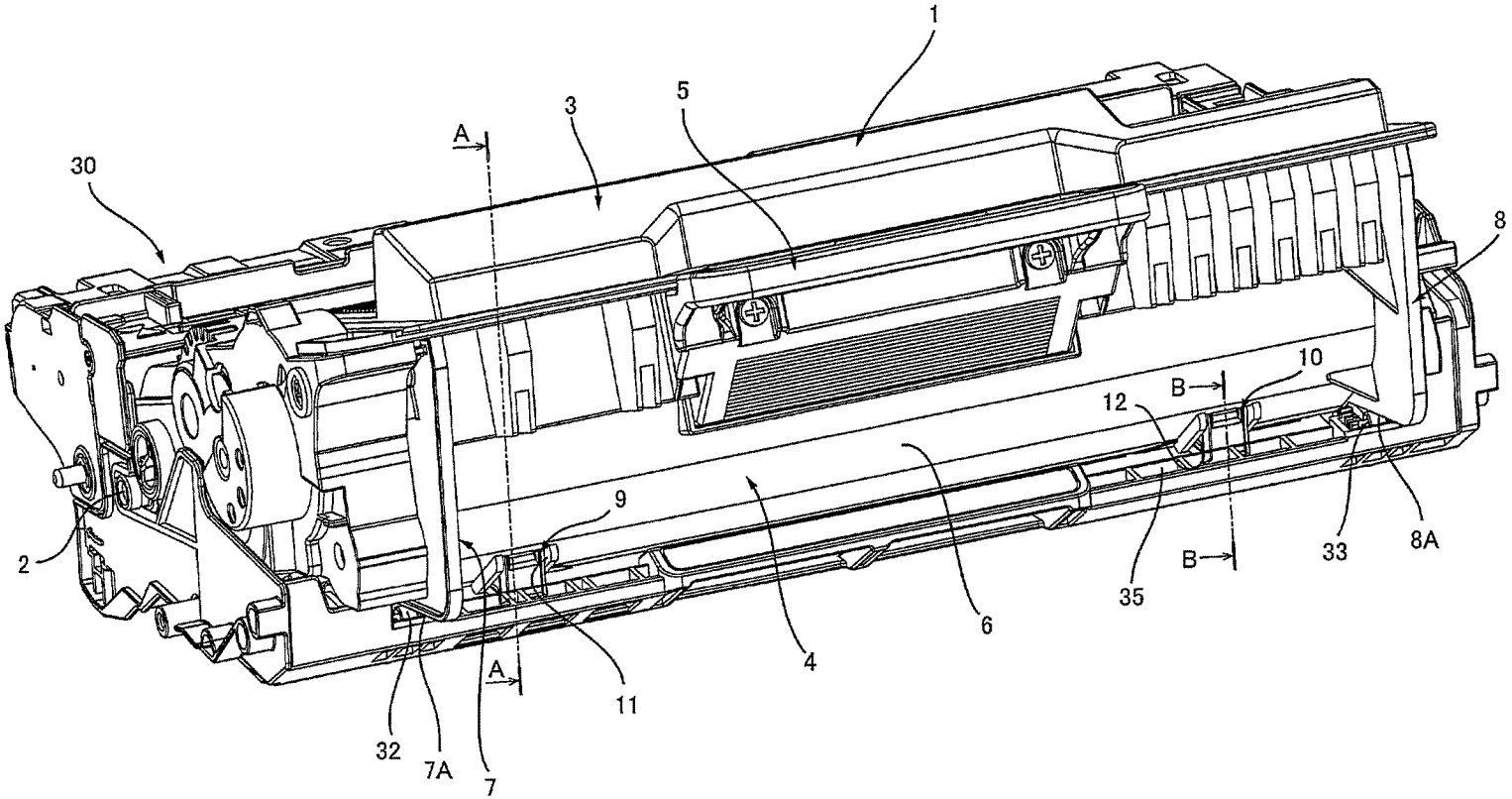
FIG. 2 is a perspective view illustrating a state where the developing cartridge according to the first embodiment is attached to a drum cartridge.

As illustrated in FIGS. 1 and 2, the first rib 7 extends in the second direction from one end portion of the developing agent accommodation chamber 4 in the first direction. That is, the first rib 7 is positioned at the one end portion of the developing agent accommodation chamber 4 in the first direction. The first rib 7 is positioned at the other side of the developing agent accommodation chamber 4 in the second direction. More specifically, the first rib 7 is positioned at the outer surface 6, and extends in the second direction from the outer surface 6.

The second rib 8 extends in the second direction from another end portion of the developing agent accommodation chamber 4 in the first direction. That is, the second rib 8 is positioned at the other end portion of the developing agent accommodation chamber 4 in the first direction. The second rib 8 is positioned at the other side of the developing agent accommodation chamber 4 in the second direction. More specifically, the second rib 8 is positioned at the outer surface 6, and extends in the second direction from the outer surface 6.

Further, the first rib 7 and the second rib 8 are spaced away from each other in the first direction, and the handle 5 is positioned between the first rib 7 and the second rib 8 in the first direction. The first rib 7 is spaced away from the handle 5 in the first direction. The second rib 8 is spaced away from the handle 5 in the first direction.

As illustrated in FIGS. 1 and 2, the developing cartridge 1 is attachable to a drum cartridge 30 including a photosensitive drum 31, a first roller 32, a second roller 33, and a frame 34. The developing cartridge 1 can be positioned with respect to the drum cartridge 30 by the first rib 7 and the second rib 8 when the developing cartridge 1 is attached to the drum cartridge 30. The first rib 7 and the second rib 8 are in contact with the drum cartridge 30 during attachment of the developing cartridge 1 to the drum cartridge 30.

More specifically, the first rib 7 has a first surface 7A. The first surface 7A is in contact with the first roller 32 during attachment of the developing cartridge 1 to the drum cartridge 30. The first surface 7A is an end portion of the first rib 7 in a third direction. The third direction may be orthogonal to the first direction and the second direction.

More specifically, the second rib 8 has a first surface 8A. The first surface 8A is in contact with the second roller 33 during attachment of the developing cartridge 1 to the drum cartridge 30. The first surface 8A is an end portion of the second rib 8 in the third direction.

1.6 First Pressure Member 9 and Second Pressure Member 10

As illustrated in FIG. 2, each of the first pressure member 9 and the second pressure member 10 is configured to press the developing roller 2 against the photosensitive drum 31 during attachment of the developing cartridge 1 to the drum cartridge 30.

The first pressure member 9 is positioned between the developing roller 2 and the handle 5 in the second direction as illustrated in FIG. 3A, and is positioned between the handle 5 and the first rib 7 in the first direction as illustrated in FIGS. 1 and 2. The first pressure member 9 is spaced away from the handle 5 in the third direction.

The second pressure member 10 is positioned between the developing roller 2 and the handle 5 in the second direction as illustrated in FIG. 3A, and is positioned between the handle 5 and the second rib 8 in the first direction as illustrated in FIGS. 1 and 2. The second pressure member 10 is spaced away from the first pressure member 9 in the first direction. Further, the second pressure member 10 is spaced away from the handle 5 in the third direction.

More specifically, each of the first pressure member 9 and the second pressure member 10 is positioned at the outer surface 6. Each of the first pressure member 9 and the second pressure member 10 is positioned opposite to the developing roller 2 with respect to the developing agent accommodation chamber 4 in the second direction. That is, each of the first pressure member 9 and the second pressure member 10 is positioned at the other side of the developing agent accommodation chamber 4 in the second direction.

As described above, the first pressure member 9 is positioned between the handle 5 and the first rib 7 in the first direction, and the second pressure member 10 is positioned between the handle 5 and the second rib 8 in the first direction. With this structure, each of the first pressure member 9 and the second pressure member 10 can be positioned at the other side of the developing agent accommodation chamber 4 in the second direction avoiding interference with the first rib 7, the second rib 8 and the handle 5 despite of the fact that the first rib 7, the second rib 8 and the handle 5 are positioned at the other side of the developing agent accommodation chamber 4 in the second direction.

As illustrated in FIG. 3A, the first pressure member 9 includes a first elastic member 13. The first elastic member 13 is a spring. The spring is an example of the elastic member. More specifically, the first elastic member 13 is a coil spring. A rubber member may be also available as the first elastic member 13 instead of the coil spring. The first elastic member 13 has one end portion 13A and another end portion 13B away from the one end portion 13A in the second direction. The one end portion 13A is fixed to the outer surface 6. The first elastic member 13 is elastically deformable. More Specifically, the first elastic member 13 can expand and contract. The other end portion 13B is movable relative to the one end portion 13A by elastic deformation (expansion and contraction) of the first elastic member 13. As illustrated in FIG. 1, the outer surface 6 has a first recessed portion 11 positioned between the handle 5 and the first rib 7 in the first direction. As illustrated in FIG. 3A, the first recessed portion 11 is recessed from the outer surface 6 toward the developing roller 2. The first pressure member 9 is positioned at the first recessed portion 11 of the outer surface 6. The first pressure member 9 further includes a first contact portion 15 fixed to the other end portion 13B. With this structure, the first contact portion 15 is movable in the second direction relative to the one end portion 13A.

Similarly, as illustrated in FIGS. 2 and 3B, the second pressure member 10 includes a second elastic member 14. The second elastic member 14 is a spring. More specifically, the second elastic member 14 is a coil spring. A rubber member may be also available as the second elastic member 14 instead of the coil spring. The second elastic member 14 has one end portion 14A and another end portion 14B away from the one end portion 14A in the second direction. The one end portion 14A is fixed to the outer surface 6. The second elastic member 14 is elastically deformable. More Specifically, the second elastic member 14 can expand and contract. The other end portion 14B is movable relative to the one end portion 14A by elastic deformation (expansion and contraction) of the second elastic member 14. As illustrated in FIG. 1, the outer surface 6 has a second recessed portion 12 positioned between the handle 5 and the second rib 8 in the first direction. As illustrated in FIGS. 2 and 3B, the second recessed portion 12 is recessed from the outer surface 6 toward the developing roller 2. The second pressure member 10 is positioned at the second recessed portion 12 of the outer surface 6. The second pressure member 10 further includes a second contact portion 16 fixed to the other end portion 14B. With this structure, the second contact portion 16 is movable in the second direction relative to the one end portion 14A.

2. Attachment of Developing Cartridge 1 to Drum Cartridge 30

Attachment of the developing cartridge 1 to the drum cartridge 30 will be described while referring FIGS. 2 through 3B. The developing cartridge 1 is attachable to and detachable from the drum cartridge 30 as illustrated in FIGS. 2 and 3A. More specifically, the developing cartridge 1 is attachable to and detachable from the frame 34 of the drum cartridge 30.

As described above, the drum cartridge 30 includes the photosensitive drum 31, the first roller 32, the second roller 33, and the frame 34. As illustrated in FIG. 3A, the photosensitive drum 31 is rotatable about an axis extending in the first direction. The photosensitive drum 31 is positioned at one end portion of the frame 34, and each of the first roller 32 and the second roller 33 is positioned at another end portion of the frame 34 in the second direction. The first roller 32 and the second roller 33 are spaced away from the photosensitive drum 31 in the second direction. The first roller 32 and the second roller 33 are spaced away from each other in the first direction. The first roller 32 is rotatable about an axis extending in the first direction. The second roller 33 is rotatable about an axis extending in the first direction.

As illustrated in FIG. 3A, the frame 34 has an end portion 35 positioned at the other end portion of the frame 34 in the second direction. The end portion 35 is positioned spaced away from the photosensitive drum 31 in the second direction. The end portion 35 is positioned between the first roller 32 and the second roller 33 in the first direction.

Upon attachment of the developing cartridge 1 to the drum cartridge 30, a surface of the developing roller 2 contacts a surface of the photosensitive drum 31. In detail, as illustrated in FIG. 3A, the first pressure member 9 contacts the end portion 35 and urges the casing 3 toward the photosensitive drum 31 in the second direction. More specifically, the first contact portion 15 contacts the end portion 35. Thus, the first elastic member 13 is compressed (contracted) such that the other end portion 13B moves toward the one end portion 13A in the second direction. The end portion 35 receives a reaction force of the first elastic member 13 through the first contact portion 15. Accordingly, the first elastic member 13 urges the outer surface 6 (the first recessed portion 11) toward the developing roller 2 in the second direction because of the elastic force of the first elastic member 13 as a result of compression thereof.

Similarly, as illustrated in FIG. 3B, upon attachment of the developing cartridge 1 to the drum cartridge 30, the second pressure member 10 contacts the end portion 35. Then, similarly to the first pressure member 9, the second pressure member 10 urges the casing 3 toward the photosensitive drum 31 in the second direction. More specifically, the second contact portion 16 contacts the end portion 35.

Thus, the second elastic member 14 is compressed (contracted) such that the other end portion 14B moves toward the one end portion 14A in the second direction. The end portion 35 receives a reaction force of the second elastic member 14 through the second contact portion 16. Accordingly, the second elastic member 14 urges the outer surface 6 (the second recessed portion 12) toward the developing roller 2 in the second direction because of the elastic force of the second elastic member 14 as a result of compression thereof. Thus, the first pressure member 9 and the second pressure member 10 urge the casing 3 toward the photosensitive drum 31, so that the developing roller 2 is pressed against the photosensitive drum 31.

Further, as illustrated in FIG. 2, the first rib 7 and the second rib 8 are in contact with the first roller 32 and the second roller 33, respectively, during attachment of the developing cartridge 1 to the drum cartridge 30, so that the developing cartridge 1 is subjected to positioning relative to the drum cartridge 30. That is, the first rib 7 contacts the first roller 32 of the drum cartridge 30 and the second rib 8 contacts the second roller 33 of the drum cartridge 30 when the developing cartridge 1 is attached to the drum cartridge 30. With this structure, positioning of the developing cartridge 1 relative to the drum cartridge 30 can be performed and the developing roller 2 can be pressed against the photosensitive drum 31 despite of the fact that the pressure members are provided at the developing cartridge 1.

3. Second Embodiment

A developing cartridge 20 according to a second embodiment will next be described with reference to FIGS. 4 through 7, wherein like parts and components are designated by the same or related reference numerals as those shown in the first embodiment.

3.1 Outline of Developing Cartridge 20

Figure 4:
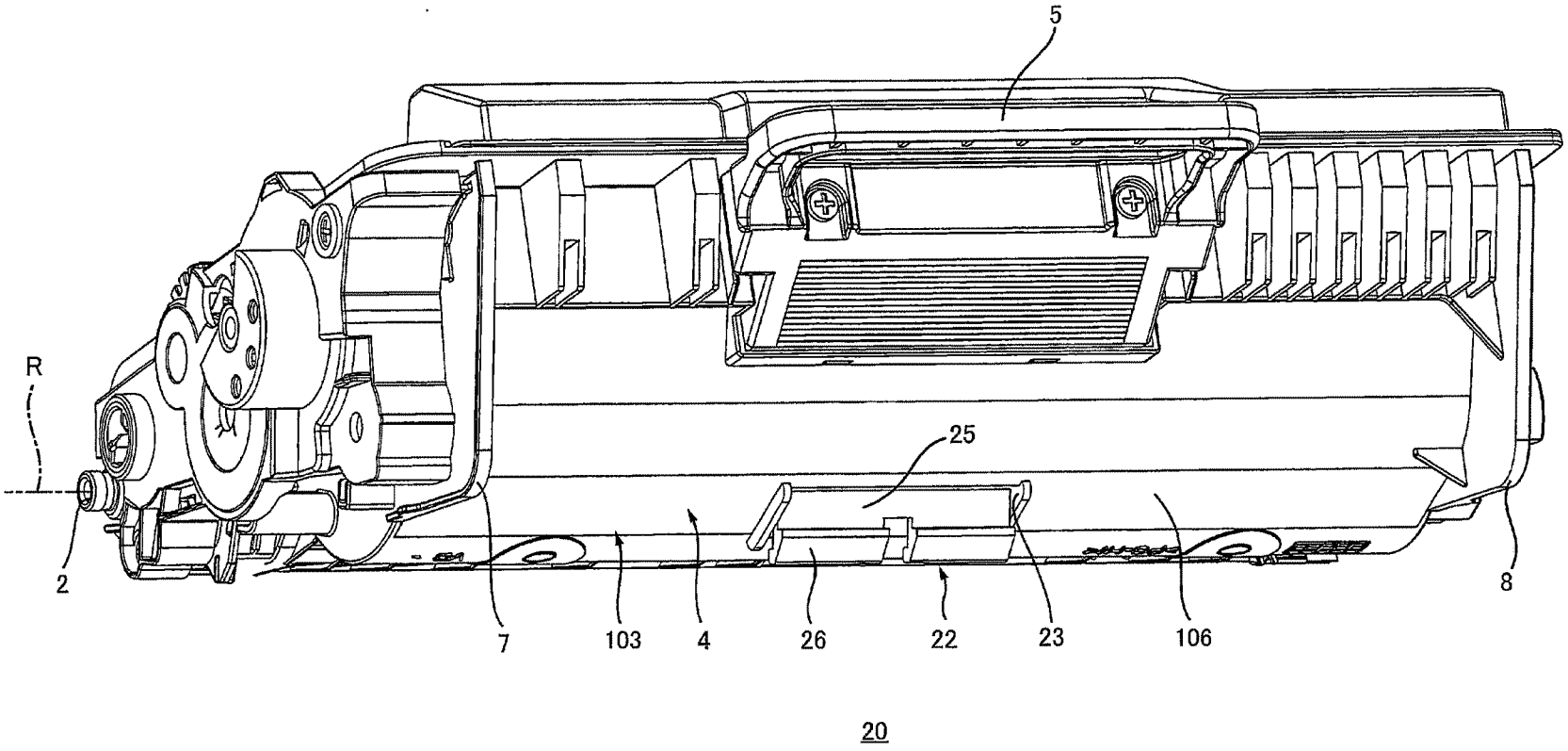
FIG. 4 is a perspective view of a developing cartridge according to a second embodiment.
Figure 5:
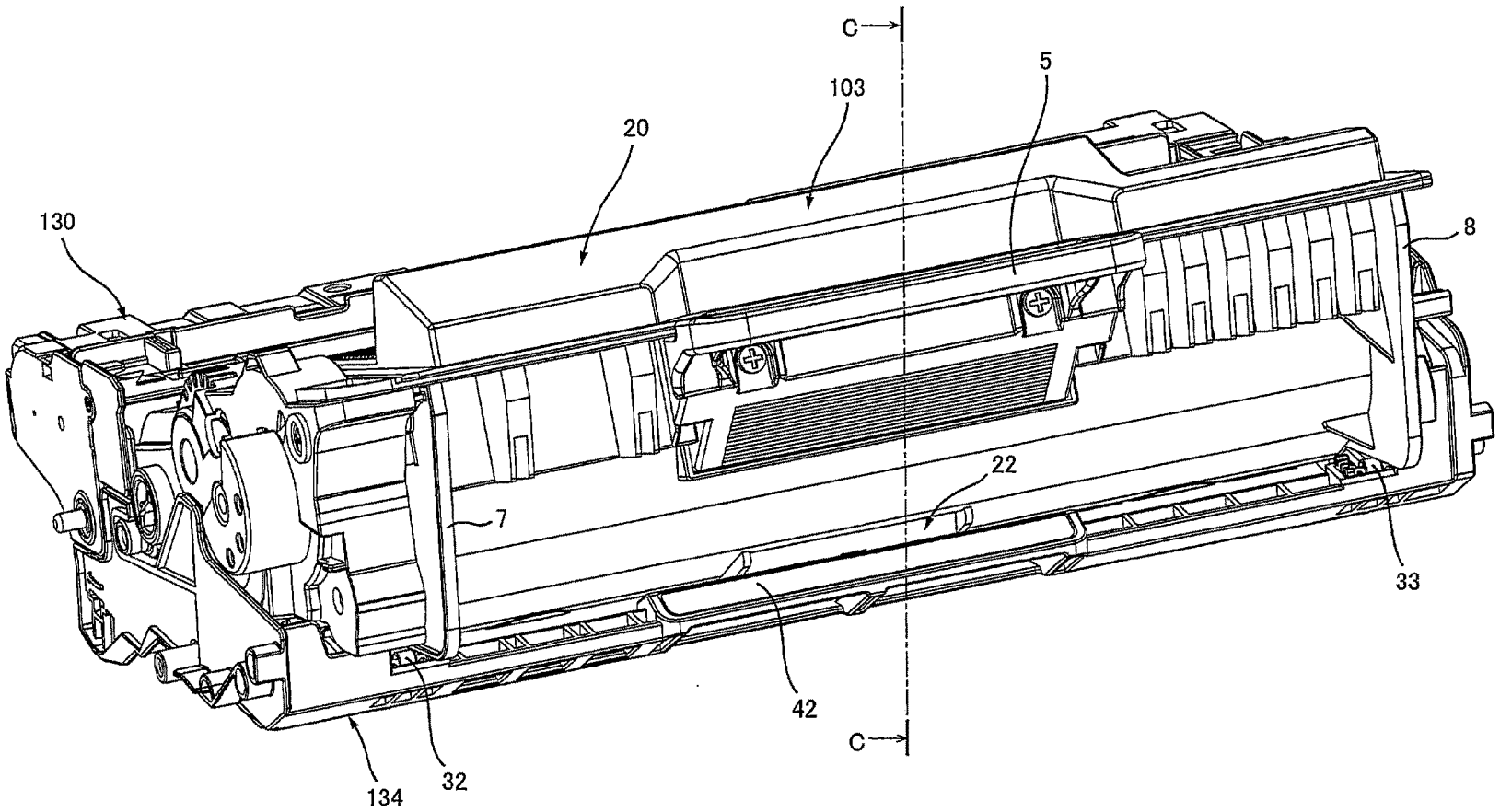
FIG. 5 is a perspective view illustrating a state where the developing cartridge according to the second embodiment is attached to a drum cartridge.

As illustrated in FIGS. 4 and 5, the developing cartridge 20 includes a casing 103 including a pressure member 22. The casing 103 is the same as the casing 3 of the first embodiment except for the pressure member 22 provided instead of the first pressure member 9 and second pressure member 10 of the first embodiment, and an outer surface 106 defined instead of the outer surface 6 of the first embodiment. The pressure member 22 is positioned at the outer surface 106. The pressure member 22 is positioned at the other side of the developing agent accommodation chamber 4 in the second direction.

3.2 Outer Surface 106

Figure 6:
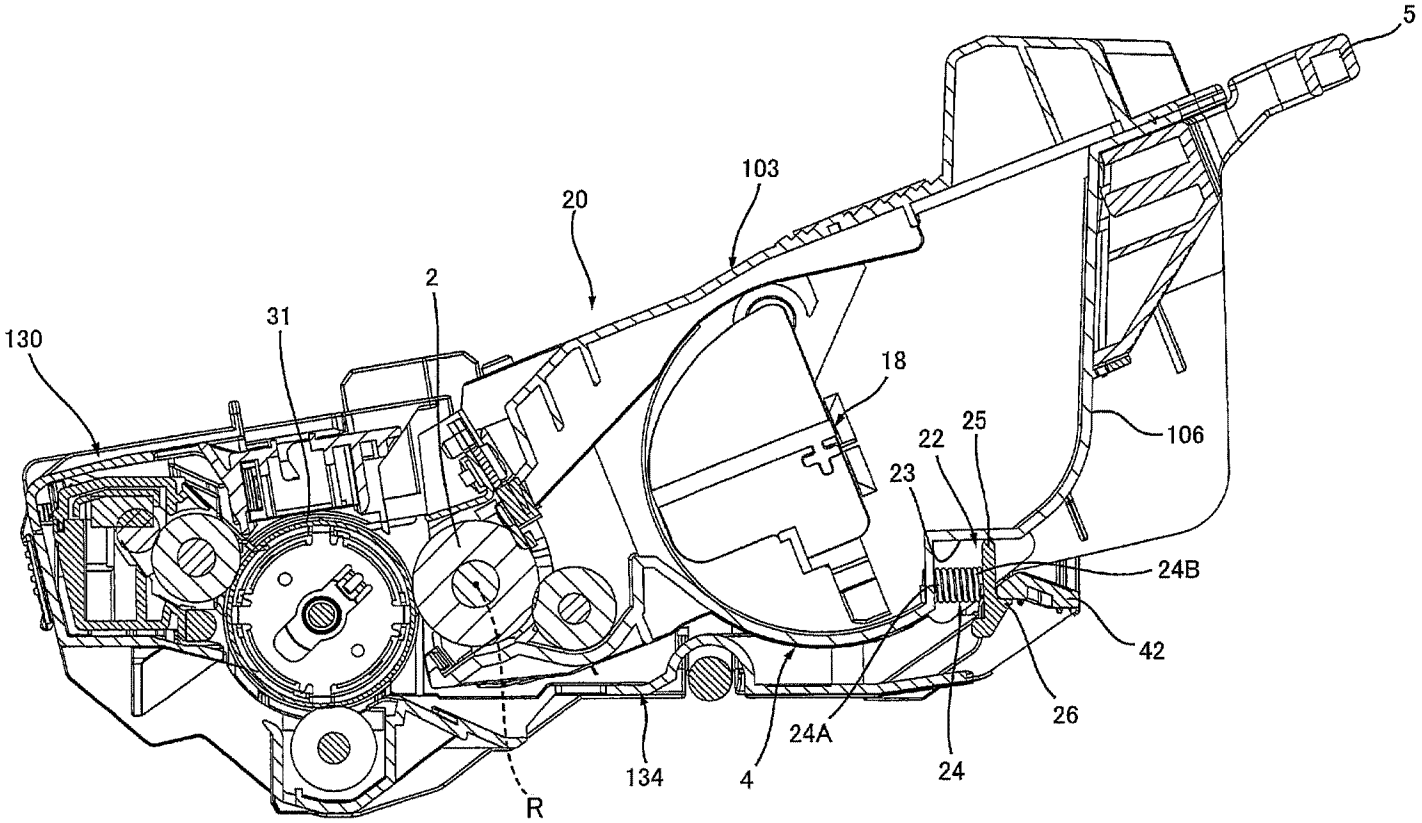
FIG. 6 is a cross-sectional view taken along a line C-C of FIG. 5.

As illustrated in FIG. 4, the casing 103 further has a recessed portion 23 for accommodating therein the pressure member 22. The recessed portion 23 is positioned at the outer surface 106. The recessed portion 23 is positioned at a position corresponding to the position of the handle 5 in the first direction. That is, the recessed portion 23 is aligned with the handle 5 in the third direction. The recessed portion 23 is positioned at an intermediate portion of the outer surface 106 in the first direction. The recessed portion 23 is spaced away from the handle 5 in the third direction. As illustrated in FIG. 6, the recessed portion 23 is recessed toward the developing roller 2 from the outer surface 106.

3.3 Pressure Member 22

As illustrated in FIG. 4, the pressure member 22 is positioned at a position corresponding to the position of the handle 5 in the first direction. That is, the pressure member 22 is aligned with the handle 5 in the third direction. With this structure, the pressure member 22 can be positioned at the other side of the developing agent accommodation chamber 4 in the second direction avoiding interference with the handle 5 in spite of the fact that the handle 5 is positioned at the other side of the developing agent accommodation chamber 4 in the second direction.

The pressure member 22 is positioned at an intermediate portion of the outer surface 106 in the first direction, and is positioned between the first rib 7 and the second rib 8 in the first direction. The pressure member 22 is positioned spaced away from the handle 5 in the third direction.

As illustrated in FIG. 6, during attachment of the developing cartridge 20 to a drum cartridge 130, the pressure member 22 can press the casing 103 toward the photosensitive drum 31 of the drum cartridge 130. The pressure member 22 includes an elastic member 24. The elastic member 24 is a spring. More specifically, the elastic member 24 is a coil spring. However, a rubber member may be available as the elastic member 24 instead of the coil spring. The elastic member 24 has one end portion 24A and another end portion 24B away from the one end portion 24A in the second direction. The one end portion 24A is fixed to the outer surface 106. The elastic member 24 is elastically deformable. More Specifically, the elastic member 24 can expand and contract. The other end portion 24B is movable relative to the one end portion 24A by elastic deformation (expansion and contraction) of the elastic member 24. The pressure member 22 is positioned at the recessed portion 23, and is positioned between the developing roller 2 and the handle 5 in the second direction. The elastic member 24 is positioned opposite to the developing roller 2 with respect to the outer surface 106.

The pressure member 22 further includes a contact portion 25 and a hook portion 26. The contact portion 25 is fixed to the other end portion 24B of the elastic member 24, so that the contact portion 25 is movable relative to the one end portion 24A in the second direction.

3.4 Attachment of Developing Cartridge 20 to Drum Cartridge 130

Attachment of the developing cartridge 20 to the drum cartridge 130 will be described while referring to FIGS. 5 and 6. The developing cartridge 20 is attachable to and detachable from the drum cartridge 130 as illustrated in FIGS. 5 and 6. The drum cartridge 130 includes a frame 134 having a handle 42. The frame 134 has one end portion and another end portion in the second direction. The handle 42 is positioned at the other end portion of the frame 134. As illustrated in FIG. 5, the handle 42 is positioned at an intermediate portion of the frame 134 in the first direction, and extends in the first direction. As illustrated in FIG. 6, the handle 42 is positioned spaced away from the photosensitive drum 31 in the second direction. The handle 42 is an example of a drum cartridge handle. The frame 134 is an example of a cartridge frame.

During attachment of the developing cartridge 20 to the drum cartridge 130, the pressure member 22 contacts the frame 134. That is, the contact portion 25 which is fixed to the other end portion 24B contacts the frame 134. More specifically, the pressure member 22 contacts the handle 42 during attachment of the developing cartridge 20 to the drum cartridge 130. In other words, the contact portion 25 contacts the handle 42 in the second direction. The elastic member 24 is compressed (contracted) such that the other end portion 24B moves toward the one end portion 24A in the second direction. The handle 42 receives a reaction force of the elastic member 24 through the contact portion 25. Because of the elastic force of the elastic member 24 as a result of compression thereof, the elastic member 24 presses the outer surface 106 (the recessed portion 23) toward the developing roller 2 in the second direction. Accordingly, the pressure member 22 presses the casing 103 toward the photosensitive drum 31, so that the developing roller 2 is pressed against the photosensitive drum 31.

During attachment of the developing cartridge 20 to the drum cartridge 130, the pressure member 22 is caught by the handle 42. More specifically, when the developing cartridge 20 is attached to the drum cartridge 130, the hook portion 26 is hooked to the handle 42, i.e., the hook portion 26 is engaged with the handle 42. This engagement prevents the developing cartridge 20 from releasing from the drum cartridge 130. That is, the developing cartridge 20 is locked with the handle 42 of the drum cartridge 130.

3.5 Detachment of Developing Cartridge 20 from Drum Cartridge 130

Figure 7:
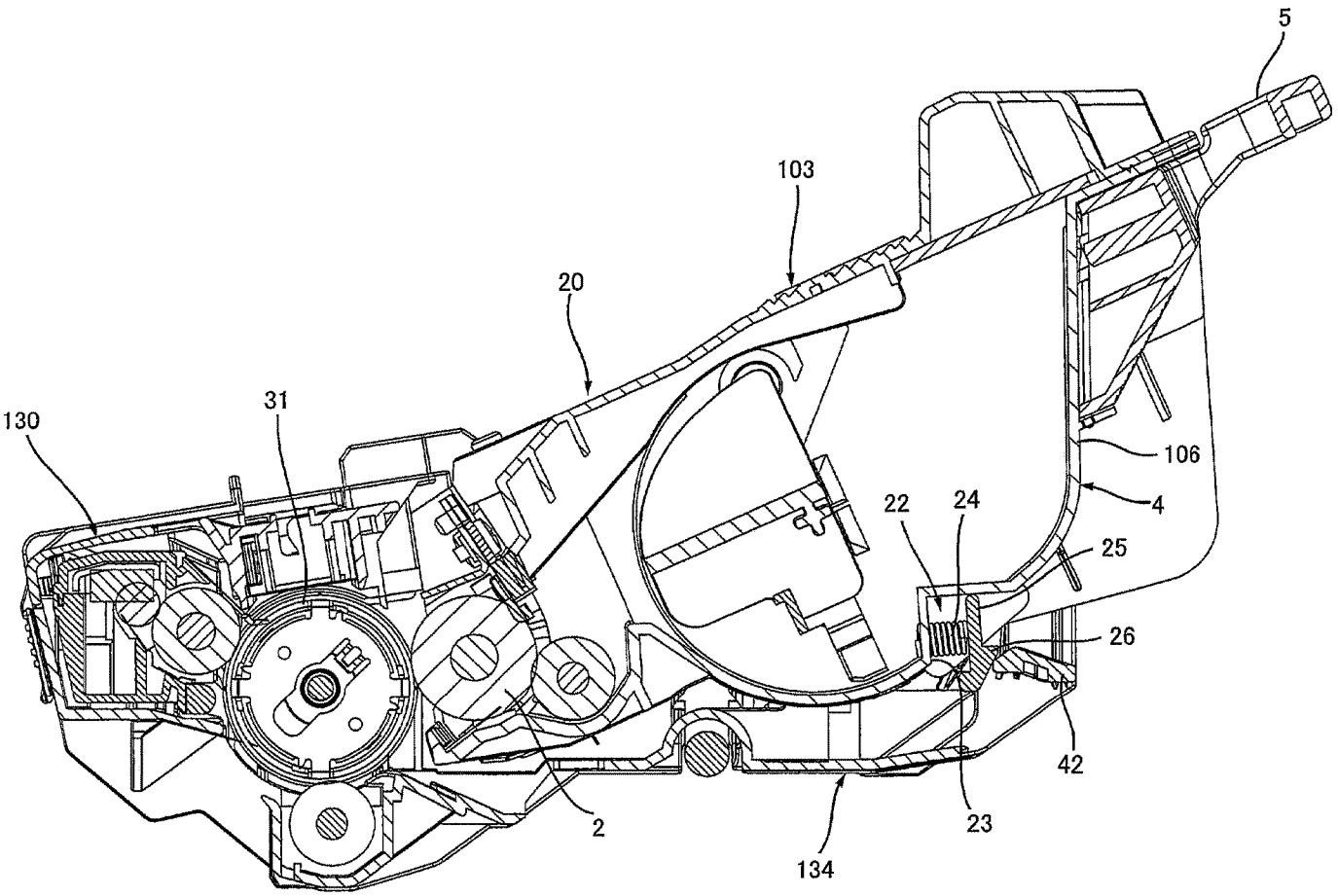
FIG. 7 is a cross-sectional view corresponding to the cross-sectional view taken along the line C-C of FIG. 5, and illustrating a state in the middle of detachment of the developing cartridge according to the second embodiment from the drum cartridge.

As illustrated in FIG. 7, when the developing cartridge 20 is detached from the drum cartridge 130, the hook portion 26 is moved toward the developing roller 2 in the second direction. More specifically, the contact portion 25 is moved toward the developing roller 2 in the second direction against the biasing force of the elastic member 24, so that the hook portion 26 is moved toward the developing roller 2 in the second direction along with the movement of the contact portion 25. Accordingly, engagement between the hook portion 26 and the handle 42 is released, thereby allowing the developing cartridge 20 to be released from the drum cartridge 130. Subsequently, the developing cartridge 20 is detached from the drum cartridge 130.

With this structure, positioning of the developing cartridge 20 relative to the drum cartridge 130 can be performed and the developing roller 2 can be pressed against the photosensitive drum 31 despite of the fact that the pressure member is provided at the developing cartridge 20. Further, in a state where the developing cartridge 20 has been attached to the drum cartridge 130 and the developing roller 2 is pressed against the photosensitive drum 31 by the pressure member 22, detachment of the developing cartridge 20 from the drum cartridge 130 can be restrained and the developing cartridge 20 can be locked with the drum cartridge 130 because of the engagement of the hook portion 26 of the developing cartridge 20 with the handle 42 of the drum cartridge 130.

While the description has been made in detail with reference to specific embodiments, it would be apparent to those skilled in the art that various changes and modifications may be made thereto.

4. Modifications

According to the first embodiment, the casing 3 includes the handle 5, the developing agent accommodation chamber 4, the first rib 7, the second rib 8, the first recessed portion 11, the second recessed portion 12, the first pressure member 9, and the second pressure member 10. However, a structure of the casing 3 is not limited to the first embodiment.

Further, as a modification to the casing 3 of the first embodiment, the first recessed portion 11 and the second recessed portion 12 can be omitted as long as the first pressure member 9 is positioned between the handle 5 and the first rib 7 in the first direction, and the second pressure member 10 is positioned between the handle 5 and the second rib 8 in the first direction.

Further, in the second embodiment, the casing 103 includes the handle 5, developing agent accommodation chamber 4, the recessed portion 23, and the pressure member 22. However, the recessed portion 23 can be omitted.

Further, according to the second embodiment, during attachment of the developing cartridge 20 to the drum cartridge 130, the contact portion 25 of the pressure member 22 contacts the handle 42 of the frame 134. Alternatively, in the pressure member 22, the elastic member 24 may contact the handle 42 during the attachment. In this case, the other end portion 24B of the elastic member 24 may contact the handle 42 during the attachment.

Further, as a modification to the first embodiment, a wall bridging between the first rib 7 and the second rib 8 in the first direction can be provided to provide a developing agent accommodation chamber. In the latter case, a third recessed portion can be formed on the wall at a position between the first rib 7 and the handle 5 in the first direction to accommodate the first pressure member 9, and a fourth recessed portion can be formed on the wall at a position between the second rib 8 and the handle 5 in the first direction to accommodate the second pressure member 10. These third and fourth recessed portions are recessed from an outer surface of the wall toward the developing roller 2.

What is claimed is:

1. A developing cartridge comprising:

a casing having an accommodation chamber configured to accommodate developing agent, the accommodation chamber having one end portion and another end portion in a first direction, the accommodation chamber having an outer surface; and a developing roller rotatable about an axis extending in the first direction, the developing roller being positioned at one side of the accommodation chamber in a second direction different from the first direction, the casing comprising:

a first rib extending in the second direction, the first rib being positioned at the outer surface, the first rib being positioned at the one end portion of the accommodation chamber in the first direction, the first rib being positioned at another side of the accommodation chamber in the second direction;

a second rib extending in the second direction, the second rib being positioned at the outer surface, the second rib being positioned at the another end portion of the accommodation chamber in the first direction, the second rib being positioned at the another side of the accommodation chamber in the second direction;

a handle positioned at the another side of the accommodation chamber in the second direction, the handle being positioned between the first rib and the second rib in the first direction;

a first pressure member positioned at the outer surface, the first pressure member being positioned at the another side of the accommodation chamber in the second direction, the first pressure member being positioned between the handle and the first rib in the first direction; and a second pressure member positioned at the outer surface, the second pressure member being positioned at the another side of the accommodation chamber in the second direction, the second pressure member being positioned between the handle and the second rib in the first direction, wherein the first pressure member comprises a first elastic member having one end portion and another end portion, the one end portion of the first elastic member being fixed to the outer surface, the another end portion of the first elastic member being movable relative to the one end portion of the first elastic member by elastic deformation of the first elastic member.

2. The developing cartridge according to claim 1, wherein the first elastic member is a spring.

3. The developing cartridge according to claim 1, wherein the second pressure member comprises a second elastic member having one end portion and another end portion, the one end portion of the second elastic member being fixed to the outer surface, the another end portion of the second elastic member being movable relative to the one end portion of the second elastic member by elastic deformation of the second elastic member.

4. The developing cartridge according to claim 3, wherein the second elastic member is a spring.

5. A developing cartridge comprising:

a casing having an accommodation chamber configured to accommodate developing agent, the accommodation chamber having one end portion and another end portion in a first direction, the accommodation chamber having an outer surface; and a developing roller rotatable about an axis extending in the first direction, the developing roller being positioned at one side of the accommodation chamber in a second direction different from the first direction, the casing comprising:

a first rib extending in the second direction, the first rib being positioned at the outer surface, the first rib being positioned at the one end portion of the accommodation chamber in the first direction, the first rib being positioned at another side of the accommodation chamber in the second direction;

a second rib extending in the second direction, the second rib being positioned at the outer surface, the second rib being positioned at the another end portion of the accommodation chamber in the first direction, the second rib being positioned at the another side of the accommodation chamber in the second direction;

a handle positioned at the another side of the accommodation chamber in the second direction, the handle being positioned between the first rib and the second rib in the first direction;

a first pressure member positioned at the outer surface, the first pressure member being positioned at the another side of the accommodation chamber in the second direction, the first pressure member being positioned between the handle and the first rib in the first direction; and a second pressure member positioned at the outer surface, the second pressure member being positioned at the another side of the accommodation chamber in the second direction, the second pressure member being positioned between the handle and the second rib in the first direction, wherein the developing cartridge is configured to be attached to a drum cartridge including a photosensitive drum, a first roller, and a second roller spaced away from the first roller in the first direction, and wherein the first rib is in contact with the first roller and the second rib is in contact with the second roller in a state where the developing cartridge is attached to the drum cartridge.

6. A developing cartridge configured to be attached to a drum cartridge including a photosensitive drum and a cartridge frame, the developing cartridge comprising:

a casing having an accommodation chamber configured to accommodate developing agent, the accommodation chamber having an outer surface; and a developing roller rotatable about an axis extending in a first direction, the developing roller being positioned at one side of the accommodation chamber in a second direction different from the first direction, the casing comprising:

a handle positioned at another side of the accommodation chamber in the second direction, the handle being positioned at the outer surface, the handle having one end and another end in the first direction; and a pressure member positioned at the outer surface, the pressure member being positioned at the another side of the accommodation chamber in the second direction, the pressure member being in contact with the cartridge frame in a state where the developing cartridge is attached to the drum cartridge, the pressure member being positioned spaced away from the handle in a third direction crossing the first direction and the second direction, at least a portion of the pressure member being positioned between the one end of the handle and the another end of the handle in the first direction, wherein the pressure member comprises an elastic member having one end portion and another end portion, the one end portion being fixed to the outer surface, the another end portion being movable relative to the one end portion by elastic deformation of the elastic member, the elastic member being compressed in a state where the developing cartridge is attached to the drum cartridge.

7. The developing cartridge according to claim 6, wherein the elastic member is a spring.

8. A developing cartridge configured to be attached to a drum cartridge including a photosensitive drum and a cartridge frame, the developing cartridge comprising:

a casing having an accommodation chamber configured to accommodate developing agent, the accommodation chamber having an outer surface; and a developing roller rotatable about an axis extending in a first direction, the developing roller being positioned at one side of the accommodation chamber in a second direction different from the first direction, the casing comprising:

a handle positioned at another side of the accommodation chamber in the second direction, the handle being positioned at the outer surface, the handle having one end and another end in the first direction; and a pressure member positioned at the outer surface, the pressure member being positioned at the another side of the accommodation chamber in the second direction, the pressure member being in contact with the cartridge frame in a state where the developing cartridge is attached to the drum cartridge, the pressure member being positioned spaced away from the handle in a third direction crossing the first direction and the second direction, at least a portion of the pressure member being positioned between the one end of the handle and the another end of the handle in the first direction, wherein the cartridge frame includes a drum cartridge handle, the pressure member being in contact with the drum cartridge handle in a state where the developing cartridge is attached to the drum cartridge.

9. The developing cartridge according to claim 8, wherein the pressure member is hooked to the drum cartridge handle in a state where the developing cartridge is attached to the drum cartridge.

10. A developing cartridge configured to be attached to a drum cartridge including a photosensitive drum and a cartridge frame, the developing cartridge comprising:

a casing having an accommodation chamber configured to accommodate developing agent, the accommodation chamber having an outer surface; and a developing roller rotatable about an axis extending in a first direction, the developing roller being positioned at one side of the accommodation chamber in a second direction different from the first direction, the casing comprising:

a handle positioned at another side of the accommodation chamber in the second direction, the handle being positioned at the outer surface, the handle having one end and another end in the first direction; and a pressure member positioned at the outer surface, the pressure member being positioned at the another side of the accommodation chamber in the second direction, the pressure member being in contact with the cartridge frame in a state where the developing cartridge is attached to the drum cartridge, the pressure member being positioned spaced away from the handle in a third direction crossing the first direction and the second direction, at least a portion of the pressure member being positioned between the one end of the handle and the another end of the handle in the first direction, wherein the pressure member comprises an elastic member having one end portion and another end portion, the one end portion being fixed to the outer surface, the another end portion being movable relative to the one end portion by elastic deformation of the elastic member, and wherein, in a state where the developing cartridge is attached to the drum cartridge, the elastic member is compressed such that the another end portion is moved toward the one end portion.

* * * * *